US011700903B2

(12) United States Patent
Ferrari et al.

(10) Patent No.: US 11,700,903 B2
(45) Date of Patent: Jul. 18, 2023

(54) ADJUSTABLE HELMET

(71) Applicant: Dick's Sporting Goods, Inc., Coraopolis, PA (US)

(72) Inventors: Lucas Ferrari, Clinton, PA (US); Chinawut Paesang, Sewickley, PA (US); Charles P. Larson, Coraopolis, PA (US); William E. Clegg, Gibsonia, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 0 days.

(21) Appl. No.: 16/901,363

(22) Filed: Jun. 15, 2020

(65) Prior Publication Data

US 2021/0100311 A1 Apr. 8, 2021

Related U.S. Application Data

(60) Provisional application No. 62/911,444, filed on Oct. 7, 2019.

(51) Int. Cl.
*A42B 3/32* (2006.01)
*A42B 3/06* (2006.01)

(52) U.S. Cl.
CPC ..... *A42B 3/324* (2013.01); *A42B 3/06* (2013.01)

(58) Field of Classification Search
CPC .. A42B 3/324; A42B 3/32; A42B 3/06; A42B 3/066; A42B 3/322; A42B 3/085; A63B 71/10
USPC ..... 2/418
See application file for complete search history.

(56) References Cited

U.S. PATENT DOCUMENTS 1,652,288 A * 12/1927 Mullins ..... A42B 3/16 2/418
3,042,927 A * 7/1962 Mauro ..... A42B 3/324 2/418
3,107,356 A * 10/1963 Pestronk ..... A42B 3/324 2/420
3,629,864 A * 12/1971 Latina ..... A42B 3/324 2/420
4,477,929 A * 10/1984 Mattsson ..... A42B 3/324 2/418

(Continued)

FOREIGN PATENT DOCUMENTS

EP 1452101 A1 9/2004
EP 2802230 B1 4/2016

*Primary Examiner* — Heather Mangine, Ph.D.
*Assistant Examiner* — Raquel M. Weis
(74) *Attorney, Agent, or Firm* — Foley & Lardner LLP

(57) ABSTRACT

An adjustable helmet includes a main shell having a first side portion, and a second side portion. The first side portion and the second side portion are laterally flexible with respect to one another. The adjustable helmet includes a secondary shell coupled to the main shell at a location between the first side portion and the second side portion. At least a portion of the first side portion and at least a portion of the second side portion each extends over at least a portion of a top surface of the secondary shell. The adjustable helmet includes a tensioning device. A first end of the tensioning device is coupled to the first side portion and a second end of the tensioning device is coupled to the second side portion so as to provide a tension force between the first side portion and the second side portion.

20 Claims, 8 Drawing Sheets

(56) References Cited

U.S. PATENT DOCUMENTS 5,953,761 A * 9/1999 Jurga ..... A42B 3/328 2/420
6,324,700 B1 * 12/2001 McDougall ..... A42B 3/324 2/420
6,385,780 B1 * 5/2002 Racine ..... A42B 3/324 2/418
6,865,752 B2 * 3/2005 Udelhofen ..... A42B 3/145 2/418
6,961,963 B2 * 11/2005 Rosie ..... A42B 3/28 128/201.24
6,966,075 B2 * 11/2005 Racine ..... A42B 3/324 2/418
6,968,575 B2 * 11/2005 Durocher ..... A42B 3/12 2/418
6,981,284 B2 * 1/2006 Durocher ..... A42B 3/12 2/425
7,870,617 B2 * 1/2011 Butler ..... A42B 3/145 2/410
7,870,618 B2 * 1/2011 Pilon ..... A42B 3/324 2/418
7,954,178 B2 * 6/2011 Durocher ..... A42B 3/324 2/418
8,037,548 B2 * 10/2011 Alexander ..... A42B 3/145 2/418
8,056,150 B2 * 11/2011 Stokes ..... A42B 3/145 2/418
8,095,995 B2 * 1/2012 Alexander ..... A42B 3/324 2/410
8,156,574 B2 * 4/2012 Stokes ..... A42B 3/145 2/418
8,296,867 B2 * 10/2012 Rudd ..... A42B 3/281 2/415
8,296,868 B2 * 10/2012 Belanger ..... A42B 3/324 2/420
8,448,266 B2 5/2013 Alexander et al.
8,510,870 B2 * 8/2013 Rogers ..... A42B 3/324 2/418
8,739,318 B2 * 6/2014 Durocher ..... A42B 3/085 2/417
8,856,973 B2 * 10/2014 Jourde ..... A42B 3/08 2/420
D725,313 S * 3/2015 Beauchamp ..... D29/102
9,226,539 B2 * 1/2016 Beauchamp ..... A42B 3/324
9,526,291 B2 * 12/2016 Beauchamp ..... A42B 3/324
9,642,409 B2 * 5/2017 Roesler ..... A42B 3/06
9,895,280 B2 * 2/2018 Ma ..... A61H 1/008
10,278,447 B2 * 5/2019 Beauchamp ..... A42B 3/324
10,306,941 B2 * 6/2019 Durocher ..... A42B 3/064
11,013,289 B1 * 5/2021 Lucero ..... A42B 3/30
2007/0169251 A1 * 7/2007 Rogers ..... A42B 3/324 2/418
2007/0266481 A1 * 11/2007 Alexander ..... A42B 3/145 2/414
2007/0266482 A1 * 11/2007 Alexander ..... A42B 3/324 2/418
2008/0184463 A1 * 8/2008 Sawabe ..... A42B 3/324 2/418
2009/0044315 A1 * 2/2009 Belanger ..... A42B 3/324 2/420
2010/0050323 A1 * 3/2010 Durocher ..... A42B 3/085 2/425
2012/0011639 A1 * 1/2012 Beauchamp ..... A42B 3/324 2/414
2012/0054947 A1 * 3/2012 Durocher ..... A42B 3/085 2/414
2012/0144564 A1 * 6/2012 Alexander ..... A42B 3/324 2/410
2013/0067645 A1 * 3/2013 Musal ..... A63B 71/10 2/424
2015/0000015 A1 * 1/2015 Beauchamp ..... A42B 3/324 2/418
2015/0007383 A1 * 1/2015 Emrich ..... A42B 3/22 2/424
2015/0250253 A1 9/2015 Jacobsen
2015/0282550 A1 * 10/2015 Musal ..... A42B 3/324 2/414
2016/0051000 A1 * 2/2016 Windham ..... A42B 3/145 2/418
2016/0286883 A1 * 10/2016 Newman ..... A42B 3/069
2017/0258168 A1 * 9/2017 Beauchamp ..... A42B 3/125
2018/0295921 A1 * 10/2018 Princip ..... A63B 71/10
2018/0325203 A1 11/2018 Cotterman
2019/0216155 A1 * 7/2019 Zents ..... A42B 3/063

* cited by examiner

ADJUSTABLE HELMET

RELATED APPLICATIONS AND CLAIM OF PRIORITY

This patent document claims priority to U.S. Patent Application No. 62/911,444, filed Oct. 7, 2019, the disclosure of which is fully incorporated into this document by reference.

BACKGROUND

Protective helmets are used for a variety of applications, particularly in ball and/or contact sports such as, for example, baseball, football, hockey, lacrosse, cricket, and/or the like. Typically, these helmets include a single molded plastic shell, along with an appropriate level of padding (e.g., foam padding, gel padding, etc.) depending on the application.

Generally, the size of the molded plastic shell and/or the thickness of padding dictates the sizing parameters of the helmet. As such, users having varying head circumferences and proportions may not be able to utilize the same helmet, and a special fitting may be necessary to determine the appropriate helmet size for each user.

In view of this limitation, adjustable helmets have been developed, which allow a user to size at least one portion of the helmet to fit the proportions of his or her head. However, such existing adjustable helmets have often relied upon complex ratcheting systems and/or locking systems to accommodate varying head circumferences. These systems can be difficult to quickly adjust, and may also result in varying compression forces on different users' heads.

Accordingly, this document generally describes various embodiments of an adjustable helmet which allows for simplified user adjustment and substantially equal compression forces regardless of a user's head size.

SUMMARY

In various embodiments, an adjustable helmet includes a main shell having a first side portion, and a second side portion. The first side portion and the second side portion are laterally flexible with respect to one another. The adjustable helmet includes a secondary shell coupled to the main shell at a location between the first side portion and the second side portion. At least a portion of the first side portion and at least a portion of the second side portion each extends over at least a portion of a top surface of the secondary shell. The adjustable helmet includes a tensioning device. A first end of the tensioning device is coupled to the first side portion and a second end of the tensioning device is coupled to the second side portion so as to provide a tension force between the first side portion and the second side portion.

The first end of the tensioning device may be coupled to the first side portion at a first hardware assembly and the second end of the tensioning device may be coupled to the second side portion at a second hardware assembly. The secondary shell may include a first wing having a first elongated track formed therethrough and a second wing having a second elongated track formed therethrough. The second wing may be located laterally opposite the first wing on the secondary shell. At least a portion of the first hardware assembly may extend through the first elongated track, and at least a portion of the second hardware assembly may extend through the second elongated track. The first elongated track may be angled downward in a first direction and the second elongated track may be angled downward in a second direction such that at least a portion of the secondary shell raises vertically when the first side portion and the second side portion of the main shell flex laterally outward with respect to one another.

The adjustable helmet may optionally include an alignment component coupled to the secondary shell. A central portion of the tensioning device may be configured to be coupled to the alignment component. The alignment component may be positioned vertically above both the first hardware assembly and the second hardware assembly.

The first side portion of the main shell may be configured to flex laterally relative to a first curved juncture region formed in the main shell. The second side portion of the main shell may be configured to flex laterally relative to a second curved juncture region formed in the main shell. The secondary shell may be coupled to the main shell at a tab formed on the main shell between the first curved juncture region and the second curved juncture region. The secondary shell may be coupled to the main shell by at least one fastener.

At least one of the secondary shell or the main shell may include at least one ventilation hole formed therethrough.

The top surface of the secondary shell may include at least one protrusion.

The main shell and the secondary shell may be formed of Acrylonitrile Butadiene Styrene (ABS) injection-molded plastic.

The adjustable helmet may include at least one padding stack coupled to the main shell and at least one padding stack separately coupled to the secondary shell. The at least one padding stack coupled to the secondary shell may be configured to extend over, but not contact, the tensioning device.

In various embodiments, a method of forming an adjustable helmet includes providing a main shell. The main shell includes a first side portion, and a second side portion. The first side portion and the second side portion are laterally flexible with respect to one another. The method includes providing a secondary shell, coupling the secondary shell to the main shell at a location between the first side portion and the second side portion such that at least a portion of the first side portion and at least a portion of the second side portion extends over at least a portion of a top surface of the secondary shell, coupling a first hardware assembly to the first side portion of the main shell, coupling a second hardware assembly to the second side portion of the main shell, coupling a first end of a tensioning device to the first hardware assembly, and coupling a second end of the tensioning device to the second hardware assembly so as to provide a tension force between the first side portion and the second side portion.

The method may include providing a first wing on a first side of the secondary shell, providing a second wing on a second side of the secondary shell, forming a first elongated track through the first wing, and forming a second elongated track through the second wing.

The method may include extending a portion of the first hardware assembly through the first elongated track, and extending a portion of the second hardware assembly through the second elongated track.

The method may include providing a plurality of padding stack, coupling at least one of the plurality of padding stacks to the main shell, and coupling at least one other of the plurality of padding stacks to the secondary shell. The at least one other of the plurality of padding stacks coupled to the secondary shell may extend over, but does not contact, the tensioning device.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The terms "approximately" and "about" when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", "front" and "rear", or "outer" and "inner," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

Figure 1:
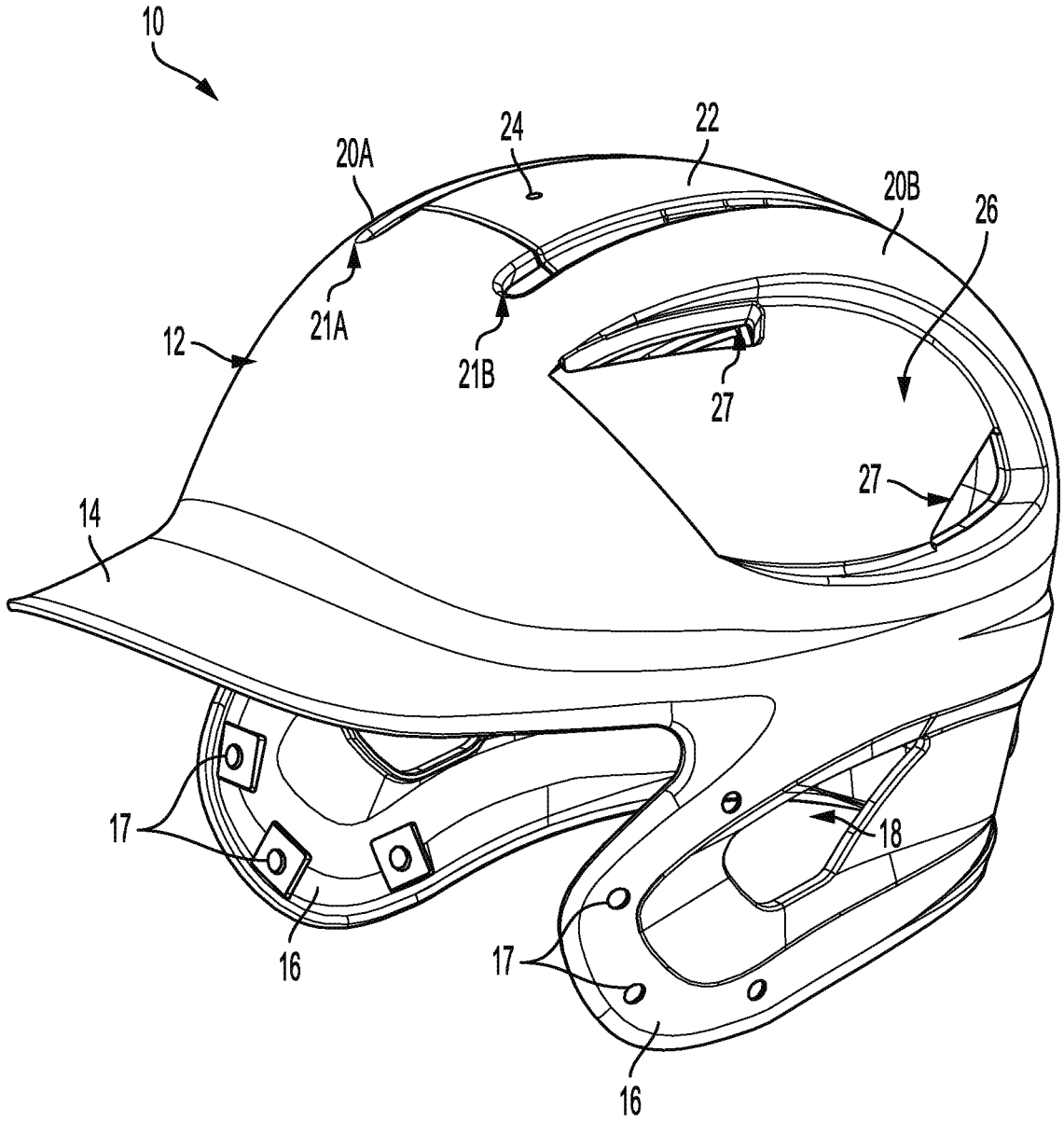
FIG. 1 illustrates a front perspective view of an example adjustable helmet.
Figure 2:
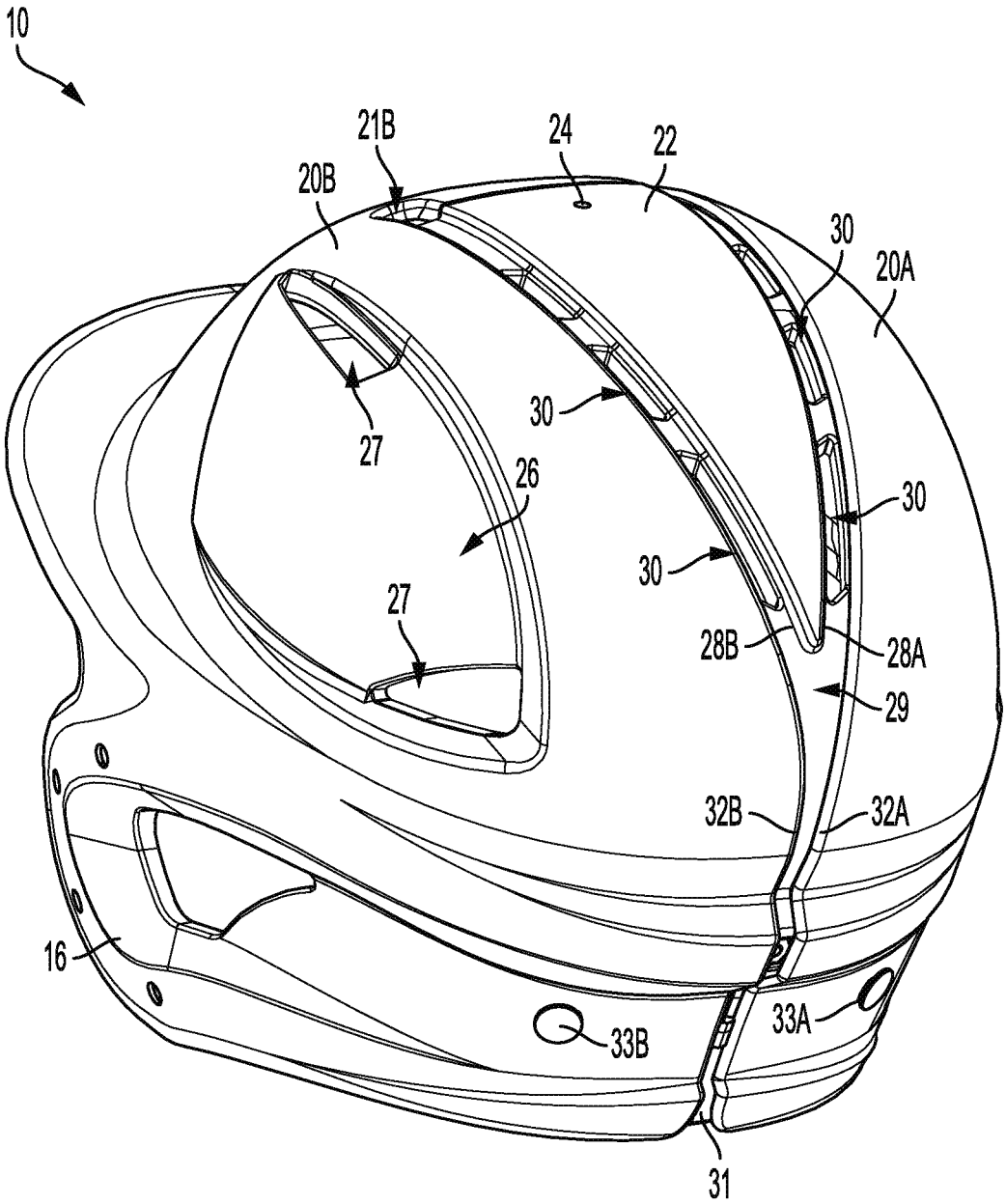
FIG. 2 illustrates a rear perspective view of an example adjustable helmet.

Referring to FIGS. 1-2, an adjustable helmet 10 in accordance with an aspect of the disclosure is illustrated. In the embodiments shown throughout, adjustable helmet 10 is configured as a batting helmet for use as part of a sporting activity, such as, for example, baseball and/or softball. However, it is to be understood that the various systems and configurations described in this document are not limited to use in batting helmets, and may be applied to helmets for other sports (e.g., hockey, football, lacrosse, cricket, cycling, auto racing, etc.) and/or helmets for use in other, non-sport applications (e.g., protective helmets for construction, emergency responders, etc.).

The adjustable helmet 10 includes a main shell 12 and a secondary shell 29. As will be described in further detail below, secondary shell 29 may be formed separately from main shell 12 and may be coupled to the main shell so as to allow movement of the shells relative to one another. Both main shell 12 and secondary shell 29 may be formed of any appropriate material such as, e.g., ABS injection-molded plastic, polypropylene, etc., and may be of any appropriate thickness (e.g., 2 mm-5 mm). However, it is to be understood that main shell 12 and secondary shell 29 may be formed of different materials and/or have differing thicknesses. Additionally, each of the main shell 12 and/or secondary shell 29 may vary in thickness throughout to allow for regions of greater impact strength, greater flexibility, etc.

Main shell 12 may include a brim portion 14 and a pair of ear flaps 16 having ear holes 18. While a pair of ear flaps 16 are shown, it is to be understood that main shell 12 may be configured with fewer than two ear flaps 16 (e.g., one ear flap or no ear flaps). Additionally, each ear flap 16 may include a plurality of mounting holes 17 for the selective attachment of, e.g., cheek guard(s), strap(s), a face mask, etc. Moreover, it is understood that main shell 12 may not have a brim or may have an alternate style of brim than that illustrated in FIG. 1.

Referring still to FIGS. 1-2, main shell 12 may include two respective side portions: a first side portion 20A and a second side portion 20B. Proximate to a front area of the main shell 12, respective juncture regions 21A, 21B are formed. Each juncture region 21A, 21B may be configured as a cut-out in the main shell 12, which allows the respective first side portion 20A and second side portion 20B to flex laterally with respect to other portions of the main shell 12, as well as with respect to the secondary shell 29. As will be described in further detail below, such lateral flexibility enables the helmet 10 to be adjustable in size. In various embodiments, one or more of the juncture regions 21A, 21B may have a curved configuration. In other embodiments, one or more of the juncture regions 21A, 21B may have a different shape or configuration.

Figure 3B:
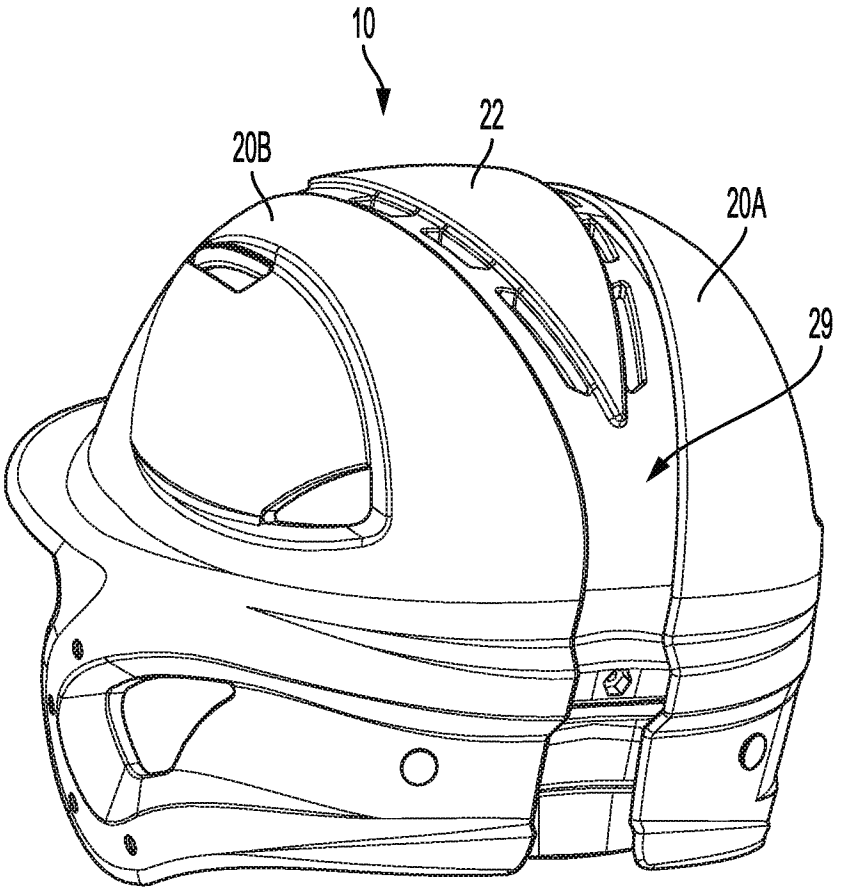
FIG. 3B illustrates a rear perspective view of an example adjustable helmet of FIG. 1 in a second configuration.
Figure 3A:
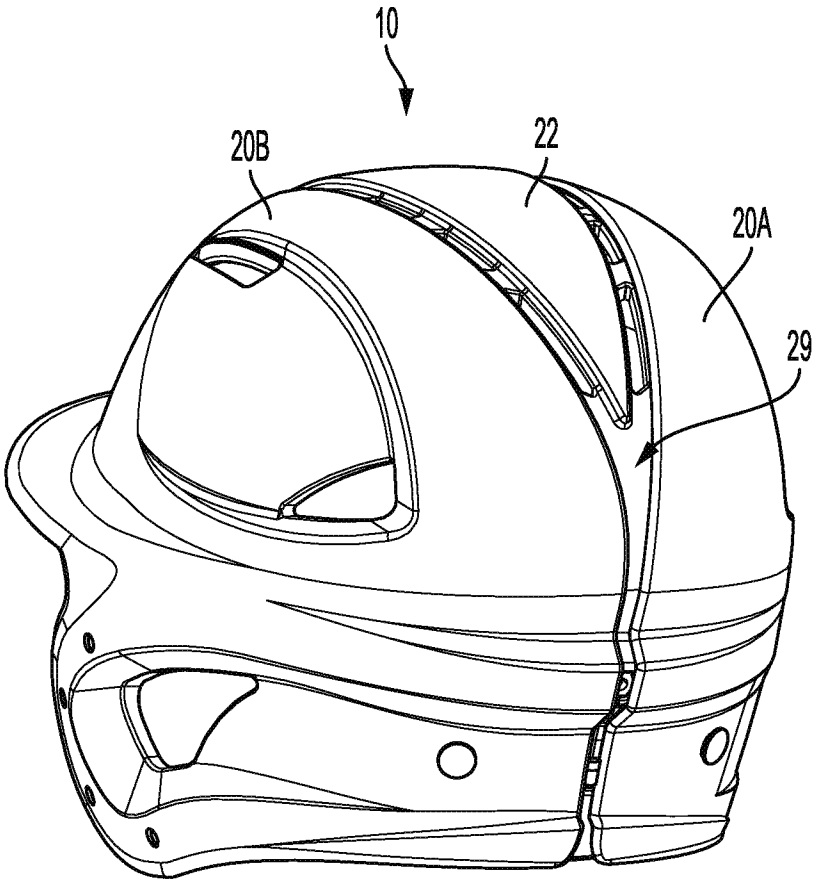
FIG. 3A illustrates a rear perspective view of an example adjustable helmet in a first configuration.

As each juncture region 21A, 21B may be curved, lateral flex of the respective side portions 20A, 20B to a certain maximum point is achievable without splitting or otherwise damaging the main shell 12. For example, referring to FIGS. 3A and 3B, helmet 10 is shown in both its least expanded configuration (FIG. 3A) and its most expanded configuration (FIG. 3B), with the respective side portions 20A, 20B flexing laterally inward or outward depending upon the proportions of the user's head. As a user slides helmet 10 over his or her head, side portions 20A, 20B flex accordingly, providing the user with an infinitely adjustable fit between the smallest configuration and the largest configuration. In some embodiments, the determination of the least expanded configuration and the most expanded configuration may be based on commonly-utilized hat sizes. For example, the least expanded configuration (FIG. 3A) may be based on a hat size of 6⅜, while the most expanded configuration (FIG. 3B) may be based on a hat size of 7⅝, with the helmet 10 being infinitely adjustable to any head size within that range. However, it is to be understood that the determination of smallest configuration and largest configuration is not limited to these stated ranges.

Referring back to FIGS. 1-2, secondary shell 29 may include a crest portion 22. The crest portion 22 may be raised relative to the remainder of secondary shell 29 by a pair of side surfaces 28A, 28B such that the crest portion is substantially flush with the outer surfaces of side portions 20A, 20B of the main shell 12. The main shell 12 may itself be raised relative to the secondary shell 29 by side portions 32A, 32B. Crest portion 22 may include an opening 24 for the insertion of a fastener (not shown) to couple the secondary shell 29 to the main shell 12. Any appropriate fastener may be utilized, such as, e.g., a screw, a rivet, etc. The secondary shell 29 may further include one or more ventilation openings 30 substantially adjacent the crest portion 22 to allow air to enter the helmet 10 through the secondary shell 29. The secondary shell 29 may extend from the crest portion 22 to a bottom portion 31, with bottom portion 31 extending as low (or substantially as low) as the side portions 20A, 20B so as to provide adequate protection to the back of the user's head.

Figure 4:
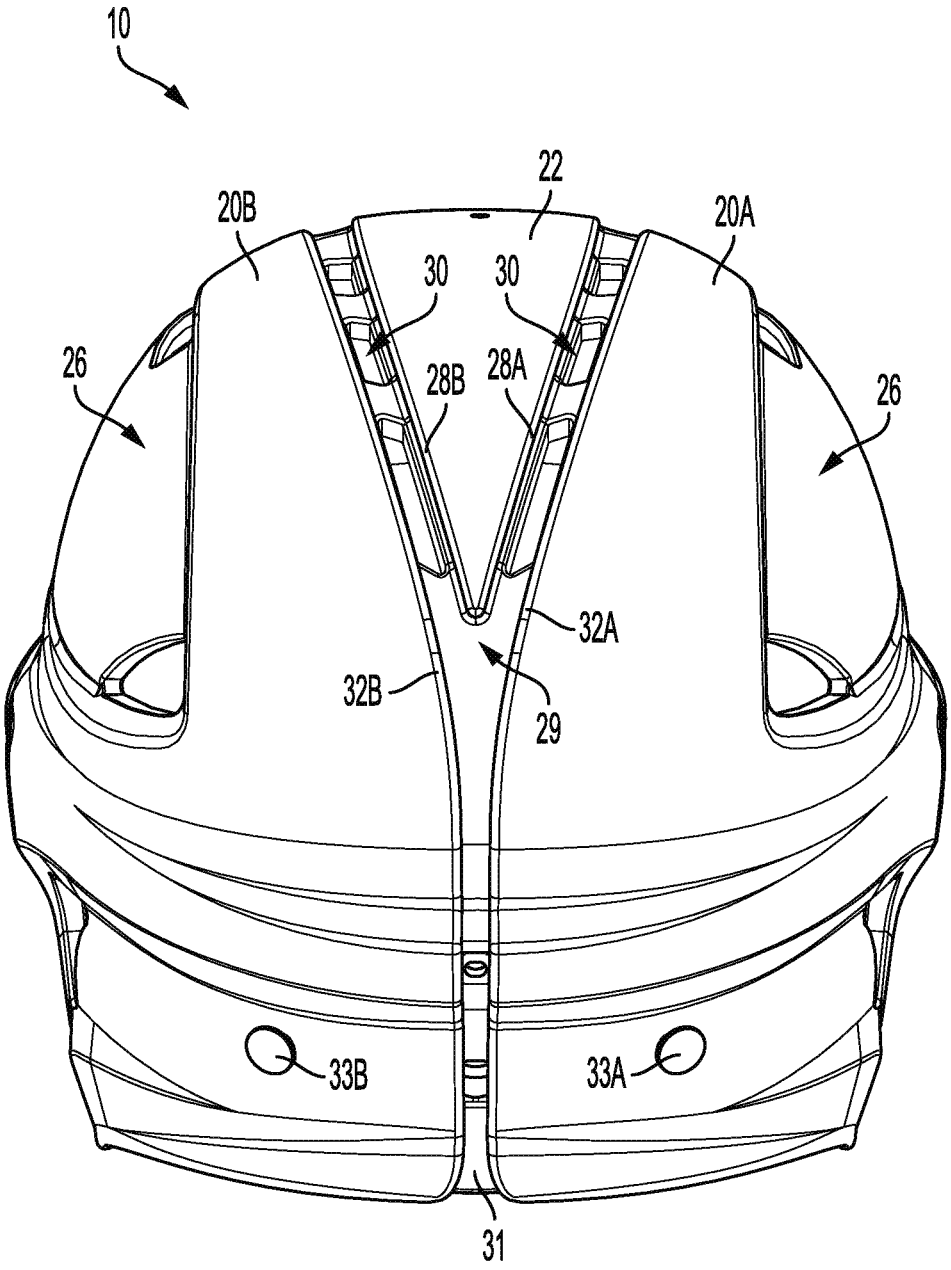
FIG. 4 illustrates a rear plan view of an adjustable helmet.

Referring to FIGS. 1-2 and FIG. 4, main shell 12 may include a pair of inset portions 26. Each inset portion 26 may include one or more ventilation openings 27. The inner surface of inset portions 26 may be substantially flush with the inner surface of secondary shell 29, thereby allowing any padding attached within a top inner portion of the helmet 10 to be of a consistent thickness and depth for improved fit and user comfort.

Figure 6:
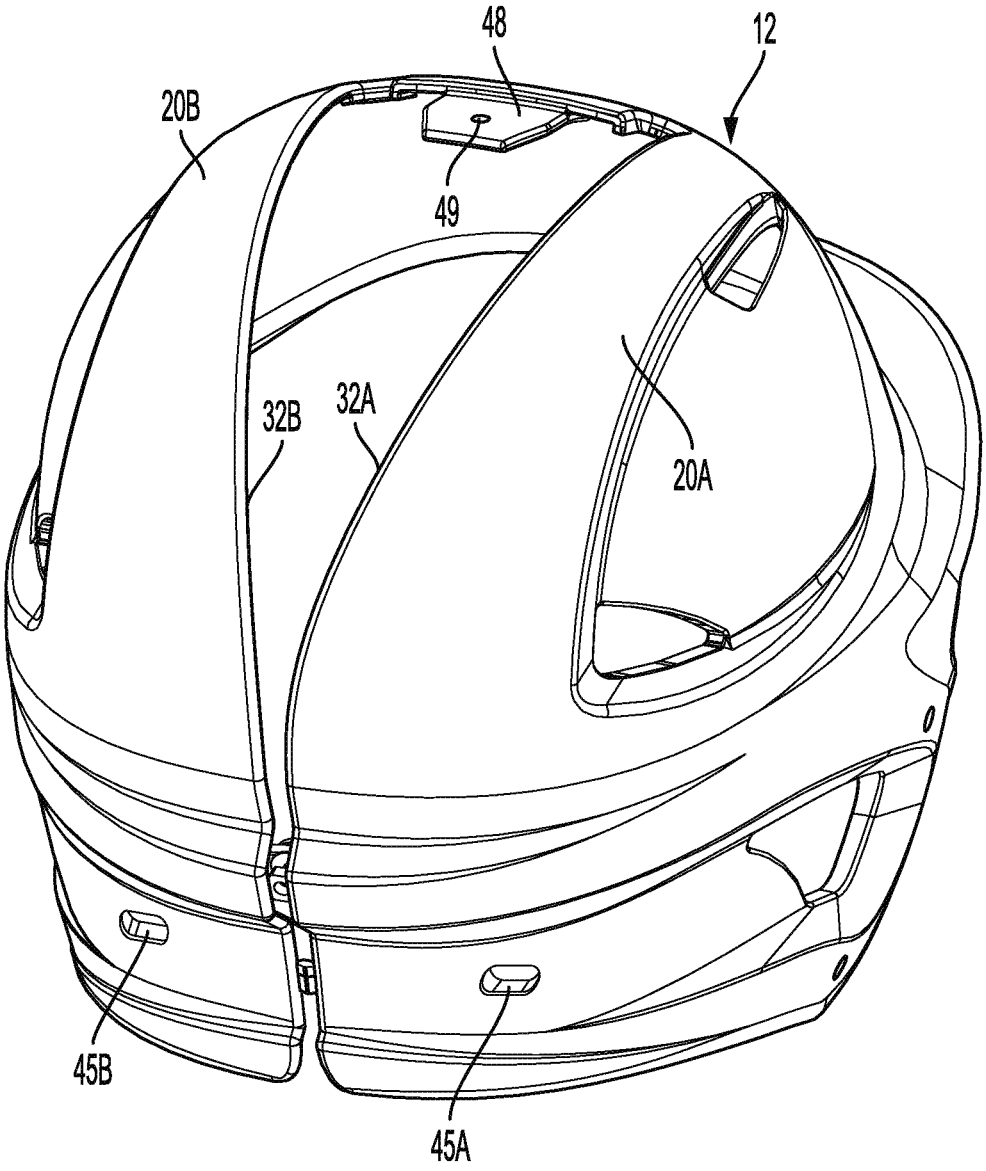
FIG. 6 illustrates a rear perspective view of an example main shell of an adjustable helmet.

As shown in FIGS. 2 and 4, a pair of fasteners 33A, 33B may be coupled to (and extend through) respective side portions 20A, 20B of the main shell 12. More specifically, the fasteners 33A, 33B may extend through respective openings 45A, 45B formed in main shell 12, as illustrated in FIG. 6. The fasteners 33A, 33B may be any appropriate fastener such as, e.g., a screw. As will be described in further detail below, the fasteners 33A, 33B may form part of a tensioning device used to enable the side portions 20A, 20B to laterally flex, yet still provide a secure and comfortable fit of the helmet 10 on the user's head. Although a pair of fasteners 33A, 33B is illustrated, it is understood that an alternate number of fasteners may be used within the scope of this disclosure.

Figure 5:
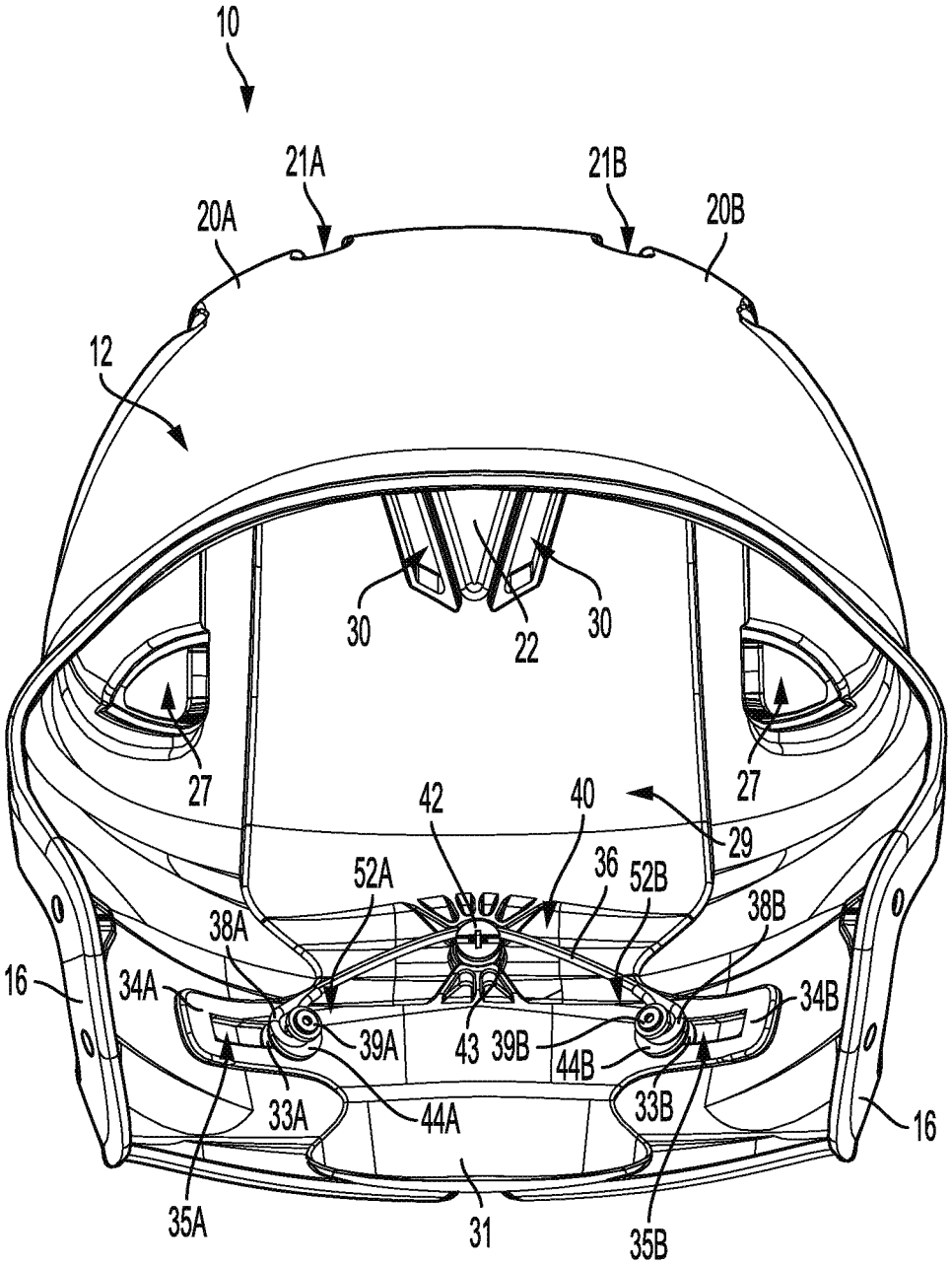
FIG. 5 illustrates an interior view of an adjustable helmet.

Referring to FIG. 5, an interior view of helmet 10 is shown. As noted above, the helmet 10 includes a tensioning device 40 which enables expansion and contraction of the side portions 20A, 20B, while providing a substantially equal compression force, regardless of the head size of the user. In some embodiments, tensioning device 40 may include an elastic tension cord 36 which extends between, and is coupled to, respective interior components 44A, 44B, which are coupled to fasteners 33A, 33B. One or more of the interior components 44A, 44B may be a nut according to various embodiments. A pair of connectors 39A, 39B (e.g., shoulder screws) may be utilized to retain the looped ends 38A, 38B of tension cord 36 such that the tension cord 36 moves in concert with any flexing of side portions 20A, 20B. The tension cord 36 may be any appropriate size and material (e.g., 3⁄32 inch diameter abrasion-resistant elastic cord), and the looped ends 38A, 38B may be formed through any appropriate method (e.g., deburred crimp wire). In some embodiments, the tension cord 36 may have a length of, e.g., between 3-4 inches. Additionally, while a tension cord 36 is shown and described, it is to be understood that any other appropriate tensioning device may be utilized, such as, e.g., one or more rubber bands, one or more springs, etc. An another example, a tensioning device may include a molded rubber or a thermoplastic polyurethane component.

A central portion of tensioning device 40 is configured to contact an alignment component 42 which is affixed to an interior surface of secondary shell 29 at a mounting point 43. An alignment component 42 may be a nut according to an embodiment. For example, a central portion of tensioning device 40 may pass over or be supported by alignment component 42. The alignment component 42 may not physically retain or obstruct movement of tensioning device 40. Instead, alignment component 42 may act as a centering point such that tension placed on the respective side portions 20A, 20B by the tensioning device 40 is substantially equal. Additionally, as is shown in FIG. 5, the alignment component 42 may be located vertically above than interior components 44A, 44B, which allows tensioning device 40 to be greater in length than if it were to pass directly between interior components 44A, 44B. With the longer tensioning device 40, the variance in elasticity force between the tensioning device 40 at its maximum point (i.e., the largest size configuration shown in FIG. 3B) and its minimum point (i.e., the smallest size configuration shown in FIG. 3A) is minimal. For example, in the smallest size configuration, the tensioning device 40 may have a force preload of, e.g., about 1 lb., while in the largest size configuration, the tensioning device may have a force of e.g., 3 lb. or less. Accordingly, all users, regardless of head size, will experience similar compression forces and, thus, similar levels of fit and comfort, as the above-stated variances in compression forces have been found to be nearly imperceptible to the user.

Referring still to FIG. 5, proximate to the bottom portion 31, secondary shell 29 may include a pair of opposing wings 34A, 34B. Each wing 34A, 34B may have a respective elongated track 35A, 35B formed therethrough. A portion of the respective track hardware assemblies 52A, 52B (which are comprised of the fasteners 33A, 33B, the interior components 44A, 44B, and the connectors 39A, 39B) extends through the respective track 35A, 35B. In this way, tracks 35A, 35B may define both the minimum and maximum adjustment limits for the helmet 10. In some embodiments, at least a portion of each track hardware assembly 52A, 52B may be configured to be cylindrical (or substantially cylindrical), which may enable that portion of the track hardware assembly to freely and smoothly ride through the tracks 35A, 35B during the user's fitting of the helmet 10.

In some embodiments, one or more tracks 35A, 35B may be angled in a downward direction from the proximal end of the wings 34A, 34B (i.e., the ends closest to the center of secondary shell 29) to the proximal end of the wings 34A, 34B (i.e., the ends farthest from the center of the secondary shell 29). As the respective side portions 20A, 20B flex to accommodate a user's head, this angulation of the tracks 35A, 35B may act to lift the bottom portion 31 of secondary shell 29 in an upward direction. In this way, any vertical gap formed between the outer surface of secondary shell 29 and the inner surface of main shell 12 due to the flexing/separation of side portions 20A, 20B may be accounted for (and closed) with corresponding upward movement of the secondary shell 29 by way of the track hardware's contact with the angled tracks 35A, 35B. As the secondary shell 29 may only be affixed to the main shell 12 at one point, such movement may be made possible. For example, as shown in FIG. 6, main shell 12 may include a tab 48 having an opening 49. The crest portion 22 may be coupled to the tab 48 by way of, e.g., a fastener extending through opening 24 (shown in FIG. 1) and opening 49. Alternatively, the secondary shell 29 may be coupled to main shell 12 by non-fastener means (e.g., an adhesive), or the secondary shell may be integrally formed (or molded) with the main shell at or near the location of tab 48.

As a user initially places helmet 10 on his or her head, the side portions 20A, 20B may flex laterally, causing the fasteners 33A, 33B (and coupled interior components 44A, 44B) to move correspondingly relative to the tracks 35A, 35B. Such movement of components 44A, 44B may cause the coupled tensioning device 40 to extend, slightly increasing the tension forces on tensioning device. Once the user finalizes placement of the helmet 10 on his or her head, the tension forces from tensioning device 40 may act on the interior components 44A, 44B (and coupled fasteners 33A, 33B) to pull the side portions 20A, 20B inward so as to create a secure and comfortable fit on the user's head without the need for ratcheting mechanisms, locking mechanisms, etc.

While the use of only one tensioning device is shown and described in this disclosure, it is to be understood that more than one tensioning device (and, therefore, additional track hardware assemblies, additional wings, additional elongated tracks, and/or other components) may be utilized in accordance with one or more other embodiments of the present disclosure.

Figure 7:
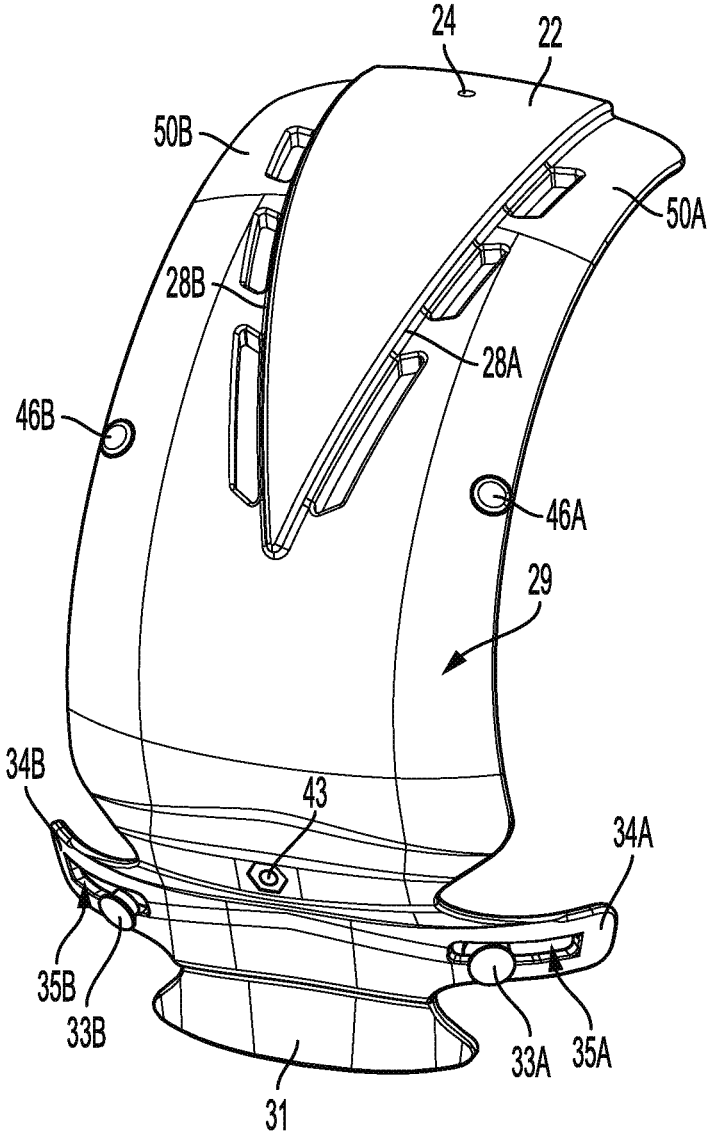
FIG. 7 illustrates a rear perspective view of an example secondary shell of an adjustable helmet.

Referring to FIG. 7, a detailed view of the outer surface of an example secondary shell 29 is shown. As described above, the secondary shell 29 may be inset relative to the main shell 12, and side portions 20A, 20B of main shell 12 may flex laterally relative to the secondary shell 29. Specifically, side portions 20A, 20B may move laterally relative to respective top surfaces 50A, 50B of secondary shell 29. In order to minimize frictional forces between the side portions 20A, 20B of main shell 12 and the top surfaces 50A, 50B of the secondary shell 29, the secondary shell 29 may include one or more protrusions 46A, 46B. The purpose of protrusions 46A, 46B is to provide a purposeful friction surface between the main shell 12 and the secondary shell 29. This friction surface may limit the friction area between the two shells and may allow for smoother movement of the side portions 20A, 20B over the top surfaces 50A, 50B of the secondary shell 29. While two protrusions 46A, 46B are shown, it is to be understood that additional or fewer protrusions 46A, 46B may be utilized.

Figure 8:
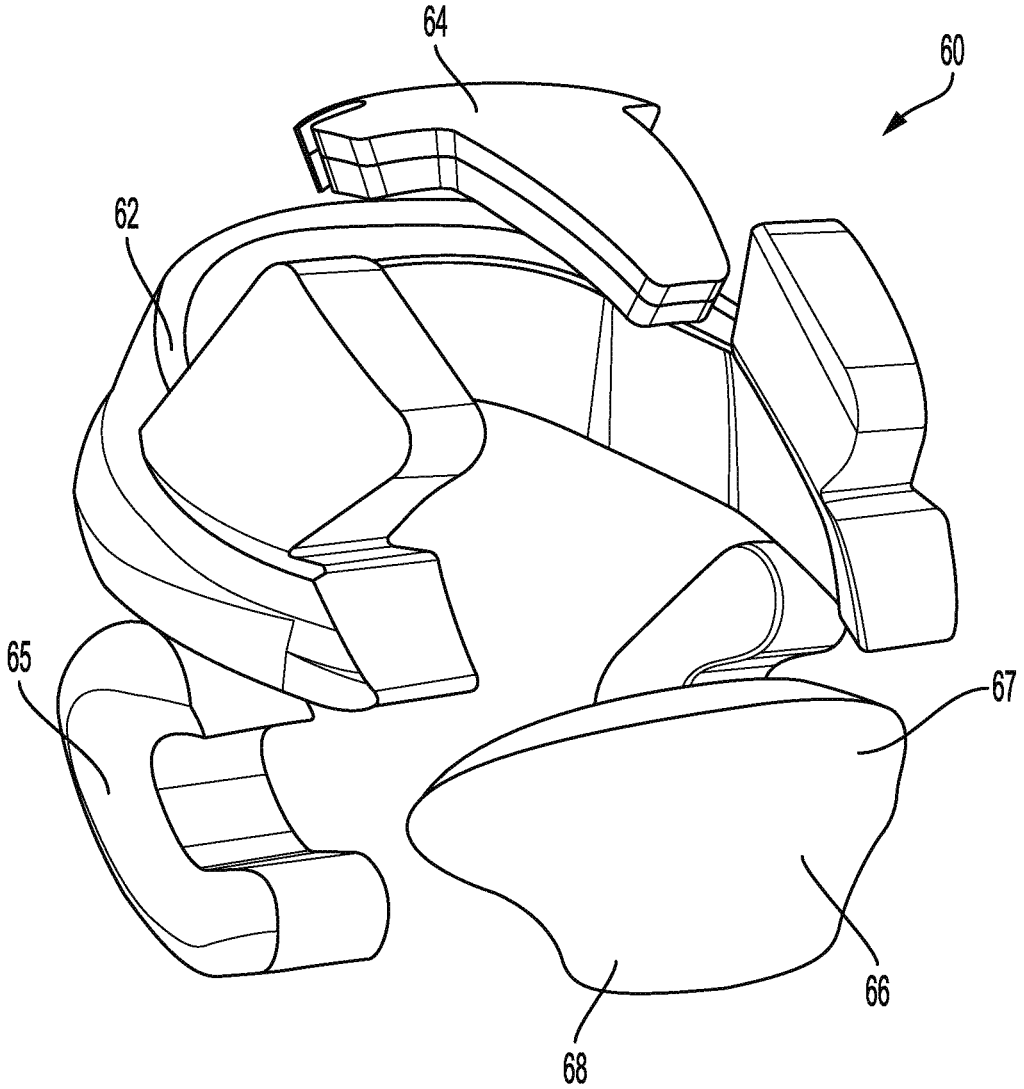
FIG. 8 illustrates a rear perspective view of an example padding arrangement for an adjustable helmet.

Referring now to FIG. 8, an example padding arrangement 60 in accordance with an aspect of the disclosure is shown. One or more pads in padding arrangement 60 may be formed of any appropriate material, such as, e.g., ethylene-vinyl acetate (EVA) foam, polyurethane (PU) die-cut comfort foam, and/or combinations thereof. Additionally, the pads in the padding arrangement may have the same or varying thicknesses. The padding arrangement 60 may include a frontal padding stack 62, a top padding stack 64, and/or one or more ear pads 65. In use with helmet 10 described above, frontal padding stack 62 and/or ear pad(s) 65 may be configured to be adhered to at least a portion of the main shell 12. Such adhesion may be by any appropriate method such as, e.g., gluing, taping, etc. Accordingly, frontal padding stack 62 and/or ear pad(s) 65 may be capable of moving in concert with the movement of side portions 20A, 20B of main shell 12, thus ensuring a secure and proper fit for the user. The top padding stack 64 may be configured to be adhered to at least a portion of the main shell 12, at least a portion of the secondary shell 29, and/or at least a portion of both the main shell and the secondary shell.

Additionally, padding arrangement 60 may include a rear padding stack 66. The rear padding stack 66 may be configured to be adhered to the secondary shell 29. Accordingly, rear padding stack 66 may be capable of movement in concert with the secondary shell 29. The geometry of the secondary shell 29 may allow for the rear padding stack 66 to be positioned within the main shell 12.

As is further shown in FIG. 8, rear padding stack 66 may be configured to cover at least a portion of the tensioning device 40 described above, while not interfering with the operation of tensioning device. The rear padding stack 66 may include a lower adhesion surface 68 which may be configured to adhere to, e.g., the lower portion 31 of secondary shell 29, while an upper adhesion surface 67 may be provided for the rear padding stack 66 to be adhered to the secondary shell 29 at a location above the tensioning device 40. In this way, the tensioning device 40 may be able to operate without interference, and the user may not feel or otherwise detect the presence of the various components of the tensioning device 40 due to the overlaid padding. The rear padding stack 66 may cover substantially the entire rear of helmet 10, the main 12 and secondary 29 shells, at all adjustment configurations.

In various embodiments, the adhesion points of the rear padding stack 66 may be positioned so that the wings 34A, 34B of the secondary shell 29 can flex and not collide with the track hardware assembly 52A, 52B as the helmet 10 is adjusted.

While rear padding stack 66 is illustrated as a single padding stack having two adhesion surfaces, it is to be understood that rear padding stack 66 may be formed as two (or more) separate padding stacks. It is also understood that alternate padding arrangements and/or configurations may be used with the adjustable helmet 10 described in this disclosure in various embodiments.

As noted above, the adjustable helmet 10 described in this document is configured as a batting helmet for use in, e.g., baseball and/or softball. However, it is to be understood that the various systems and configurations described in this document (including the tensioning device 40) are not limited to use in batting helmets, and may be applied to helmets for other sports (e.g., hockey, football, lacrosse, cricket, cycling, auto racing, etc.) and/or helmets for use in other, non-sport applications (e.g., protective helmets for construction, emergency responders, etc.).

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. An adjustable helmet, comprising:

a main shell, comprising:

a first side portion, and a second side portion, wherein the first side portion and the second side portion are laterally flexible with respect to one another between a first position and a second position;

a secondary shell coupled to the main shell at a location between the first side portion and the second side portion, wherein at least a portion of the first side portion and at least a portion of the second side portion each extends over at least a portion of a top surface of the secondary shell;

a tensioning device comprising an elastic component, wherein a first end of the elastic component is connected to the first side portion and a second end of the elastic component is connected to the second side portion so as to provide a tension force between the first side portion and the second side portion, the tension force biasing the first side portion and the second side portion towards the first position;

and an alignment component coupled to the elastic component, wherein the alignment component provides a centering point that will distribute the tension force equally between the first side portion and the second side portion as the first side portion and the second side portion flex relative to one another.

2. The adjustable helmet of claim 1, wherein the first end of the tensioning device is coupled to the first side portion at a first hardware assembly and the second end of the tensioning device is coupled to the second side portion at a second hardware assembly.

3. The adjustable helmet of claim 2, wherein the secondary shell comprises:

a first wing having a first elongated track formed therethrough; and a second wing having a second elongated track formed therethrough, wherein the second wing is located laterally opposite the first wing on the secondary shell.

4. The adjustable helmet of claim 3, wherein:

at least a portion of the first hardware assembly extends through the first elongated track, at least a portion of the second hardware assembly extends through the second elongated track.

5. The adjustable helmet of claim 4, wherein the first elongated track is angled downward in a first direction and the second elongated track is angled downward in a second direction such that at least a portion of the secondary shell raises vertically when the first side portion and the second side portion of the main shell flex laterally outward with respect to one another.

6. The adjustable helmet of claim 2, wherein the alignment component is coupled to the secondary shell, wherein a central portion of the elastic component is coupled to the alignment component.

7. The adjustable helmet of claim 6, wherein the alignment component is positioned vertically above both the first hardware assembly and the second hardware assembly.

8. The adjustable helmet of claim 1, wherein the first side portion of the main shell is configured to flex laterally relative to a first curved juncture region formed in the main shell, and the second side portion of the main shell is configured to flex laterally relative to a second curved juncture region formed in the main shell.

9. The adjustable helmet of claim 8, wherein the secondary shell is coupled to the main shell at a tab formed on the main shell between the first curved juncture region and the second curved juncture region.

10. The adjustable helmet of claim 9, wherein the secondary shell is coupled to the main shell by at least one fastener.

11. The adjustable helmet of claim 1, wherein at least one of the secondary shell or the main shell comprise at least one ventilation hole formed therethrough.

12. The adjustable helmet of claim 1, wherein the main shell and the secondary shell are formed of Acrylonitrile Butadiene Styrene (ABS) injection-molded plastic.

13. The adjustable helmet of claim 1, further comprising at least one padding stack coupled to the main shell and at least one padding stack separately coupled to the secondary shell.

14. The adjustable helmet of claim 13, wherein the at least one padding stack coupled to the secondary shell is configured to extend over, but not contact, the tensioning device.

15. The adjustable helmet of claim 1, wherein the first position is smaller than the second position.

16. A method of forming an adjustable helmet, the method comprising:

providing a main shell, the main shell comprising:

a first side portion, and a second side portion, wherein the first side portion and the second side portion are laterally flexible with respect to one another between a first position and a second position;

providing a secondary shell;

coupling the secondary shell to the main shell at a location between the first side portion and the second side portion such that at least a portion of the first side portion and at least a portion of the second side portion extends over at least a portion of a top surface of the secondary shell;

coupling a first hardware assembly to the first side portion of the main shell;

coupling a second hardware assembly to the second side portion of the main shell;

connecting a first end of an elastic component to the first hardware assembly;

connecting a second end of the elastic component to the second hardware assembly so as to provide a tension force between the first side portion and the second side portion, the tension force biasing the first side portion and the second side portion towards the first position; and coupling an alignment component to the elastic component, wherein the alignment component provides a centering point that will distribute the tension force equally between the first side portion and the second side portion as the first side portion and the second side portion flex relative to one another.

17. The method of claim 16, further comprising:

providing a first wing on a first side of the secondary shell;

providing a second wing on a second side of the secondary shell;

forming a first elongated track through the first wing; and forming a second elongated track through the second wing.

18. The method of claim 17, further comprising:

extending a portion of the first hardware assembly through the first elongated track; and extending a portion of the second hardware assembly through the second elongated track.

19. The method of claim 16, further comprising:

providing a plurality of padding stacks;

coupling at least one of the plurality of padding stacks to the main shell; and coupling at least one other of the plurality of padding stacks to the secondary shell, wherein the at least one other of the plurality of padding stacks coupled to the secondary shell extends over, but does not contact, the tensioning device.

20. The method of claim 16, wherein the first position is smaller than the second position.

* * * * *